US009557021B2

(12) United States Patent
Madden et al.

(10) Patent No.: US 9,557,021 B2
(45) Date of Patent: Jan. 31, 2017

(54) RECESSED LED LIGHT FIXTURE

(71) Applicant: CORDELIA LIGHTING, INC., Rancho Dominguez, CA (US)

(72) Inventors: James Madden, Philadelphia, PA (US); Seth Chang, Rowland Heights, CA (US); Huan C. Nguyen, Anaheim, CA (US); Joseph Jecen, Mt. Holly, NJ (US)

(73) Assignee: CORDELIA LIGHTING, INC., Rancho Dominguez, CA (US)

( * ) Notice: Subject to any disclaimer, the term of this patent is extended or adjusted under 35 U.S.C. 154(b) by 144 days.

(21) Appl. No.: 14/205,162

(22) Filed: Mar. 11, 2014

(65) Prior Publication Data

US 2014/0268801 A1 Sep. 18, 2014

Related U.S. Application Data

(60) Provisional application No. 61/785,290, filed on Mar. 14, 2013, provisional application No. 61/836,474, filed on Jun. 18, 2013.

(51) Int. Cl.
*F21V 15/00* (2015.01)
*F21V 17/00* (2006.01)
(Continued)

(52) U.S. Cl.
CPC ..... *F21S 8/026* (2013.01); *F21V 23/008* (2013.01); *F21V 29/15* (2015.01); *F21V 29/70* (2015.01); *F21Y 2101/00* (2013.01)

(58) Field of Classification Search
CPC ..... F21S 8/026; F21V 23/008
See application file for complete search history.

(56) References Cited

U.S. PATENT DOCUMENTS 4,277,641 A * 7/1981 Bauer ..... H02G 3/083 174/661
7,703,951 B2 4/2010 Piepgras et al.
(Continued)

FOREIGN PATENT DOCUMENTS

CA 2741071 8/2011
CN 201448704 U 5/2010

OTHER PUBLICATIONS

Examiner's Report, Canadian App. No. 2,846,521, Canadian Intellectual Property Office, Jun. 9, 2015 (counterpart to U.S. Appl. No. 14/205,162).

(Continued)

*Primary Examiner* — Peggy Neils
*Assistant Examiner* — Alexander Garlen
(74) *Attorney, Agent, or Firm* — Pauly Y. Feng; One LLP

(57) ABSTRACT

A solid state, recessed light fixture for residential and commercial lighting applications. The fixture includes a truncated cone-shaped trim having a concave bottom surface and a convex top surface, wherein the trim has a sloped circumferential wall that leads to a flat, annular lip at its periphery. An LED array is mounted to the underside within the concave bottom surface and a LED driver is mounted to the top surface. A cover with an open bottom partially encloses the LED driver and a junction box with cable openings and knock out ports is stacked on top of the cover. The cover is a thermal insulator to contain heat from the LED driver inside while the trim acts as a thermal conductor and radiator for the LED driver. No "can" housing is needed to enclose the fixture, and no finned, heat sink is needed to dissipate heat.

17 Claims, 8 Drawing Sheets

(51) Int. Cl.

| | |
|---|---|
| ***F21S 8/02*** | (2006.01) |
| ***F21V 23/00*** | (2015.01) |
| ***F21V 29/15*** | (2015.01) |
| ***F21V 29/70*** | (2015.01) |
| *F21Y 101/00* | (2016.01) |

(56) References Cited

U.S. PATENT DOCUMENTS

| | | | | |
|---|---|---|---|---|
| 7,722,227 | B2 | 5/2010 | Zhang et al. | |
| 8,454,204 | B1 | 6/2013 | Chang et al. | |
| 8,534,873 | B1 | 9/2013 | Soderman et al. | |
| 2005/0265016 | A1* | 12/2005 | Rappaport | F21S 8/02 362/147 |
| 2006/0221620 | A1 | 10/2006 | Thomas | |
| 2010/0277905 | A1* | 11/2010 | Janik | F21K 9/00 362/235 |
| 2011/0075411 | A1* | 3/2011 | Van De Ven | F21S 48/328 362/235 |
| 2011/0075414 | A1 | 3/2011 | Van De Ven et al. | |
| 2011/0080727 | A1* | 4/2011 | Maxik | F21S 8/026 362/235 |
| 2011/0141741 | A1 | 6/2011 | Engstrom et al. | |
| 2012/0182744 | A1 | 7/2012 | Santiago et al. | |
| 2012/0218764 | A1* | 8/2012 | Williamson | F21V 29/20 362/294 |
| 2013/0120963 | A1* | 5/2013 | Holland | F21V 7/0066 362/84 |
| 2013/0201679 | A1 | 8/2013 | Pickard et al. | |
| 2013/0250579 | A1* | 9/2013 | Athalye | F21V 21/00 362/296.05 |
| 2014/0049957 | A1* | 2/2014 | Goelz | F21V 29/763 362/235 |

OTHER PUBLICATIONS

Hilton W.C. Sue, Canadian associate letter to patent practitioner Paul Feng enclosing Examiner's Report, Oct. 18, 2015.

Sills Cummis & Gross, Petition for Inter Partes Review No. IPR2015-01420, Jun. 16, 2015.

Exhibits Supporting Petition for Inter Partes Review No. IPR2015-01420.

ONE LLP, Patent Owner's Preliminary Response In Inter Partes Review No. IPR2015-01420, Sep. 30, 2015.

Exhibits Supporting Patent Owner's Preliminary Response in Inter Partes Review No. IPR2015-01420.

* cited by examiner

RECESSED LED LIGHT FIXTURE

CROSS-REFERENCE TO RELATED APPLICATIONS

This application claims priority to U.S. provisional patent application No. 61/785,290, filed Mar. 14, 2013, and to U.S. provisional patent application No. 61/836,474, filed Jun. 18, 2013, the contents of which are incorporated herein by reference

FIELD OF THE INVENTION

The present invention relates to recessed lighting fixtures. In particular, the present invention relates to a LED light fixture preferable used for installation to sheetrock type ceiling structures.

BACKGROUND OF THE INVENTION

Sheetrock is a trade name for drywall or wall board used in residential home or commercial building construction. It is typically a pre-hardened plaster of Paris, also known as gypsum. It is sold in large sheets and applied as an interior wall surface. In one particular application, sheetrock is used in the ceiling in large sheets or as ceiling tiles. This material is relatively rigid and allows various light fixtures of difference sizes and weights to be attached to it due to its strength. One type of light fixture is a recessed fixture that installs into a hole created in the sheetrock. The light fixture hardware such as the junction box, housing, support legs or clips are hidden behind the ceiling. From below looking up to the installed fixture, the light source (e.g., incandescent bulb, LED cluster, fluorescent tube, etc.) with or without a lens or diffuser, trim or reflector, and trim ring are visible from below, with the trim ring and lens sitting about flush against the sheetrock surface.

SUMMARY OF THE INVENTION

The present invention in a preferred embodiment is directed to a recessed, solid state light fixture, having a truncated-cone-shape trim with a top surface and a concave bottom surface; an LED array disposed on the bottom surface of the trim; a reflector disposed within the concave bottom surface surrounding the LED array; an LED driver disposed on the top surface of the trim and electrically wired to the LED array; a cover having a top and an open bottom at least partially enclosing the LED driver; a junction box stacked directly on top of the cover and electrically wired to the LED driver, the junction box having ports with biased flap doors and punch outs for cable and wire access; a plurality of spring-biased brackets disposed on the top surface of the trim at a periphery thereof. With the preferred embodiment design, a conventional, finned heat sink and a "can" housing are unnecessary and omitted.

An optional trim ring can be attached to the bottom of the trim to improve appearance and to customize the light fixture to comport with interior design themes. The trim ring can be attached preferably by magnets so that the trim ring can be removed and changed as desired. A lens cover or diffuser may be used to enclose the bottom of the trim. The optional reflector may be installed inside the trim to reflect the light from the LED array, or the interior of the trim may be coated or painted with reflective material.

The cover for the LED driver leaves a space between it and the LED driver where that open space acts as a thermal insulation barrier. Further, the cover is preferably made from a thermally insulating material to keep the heat generated by the LED driver contained therein. In one embodiment, the LED driver further includes feet or bosses on the bottom so that it is spaced away from the trim, wherein this interstitial air space acts as a thermal barrier. In another embodiment, the LED driver is in flush contact with the trim underneath, where heat from the LED driver is transferred via conduction to the trim which then radiates the heat away.

DETAILED DESCRIPTION OF THE PREFERRED EMBODIMENTS

Figure 1:
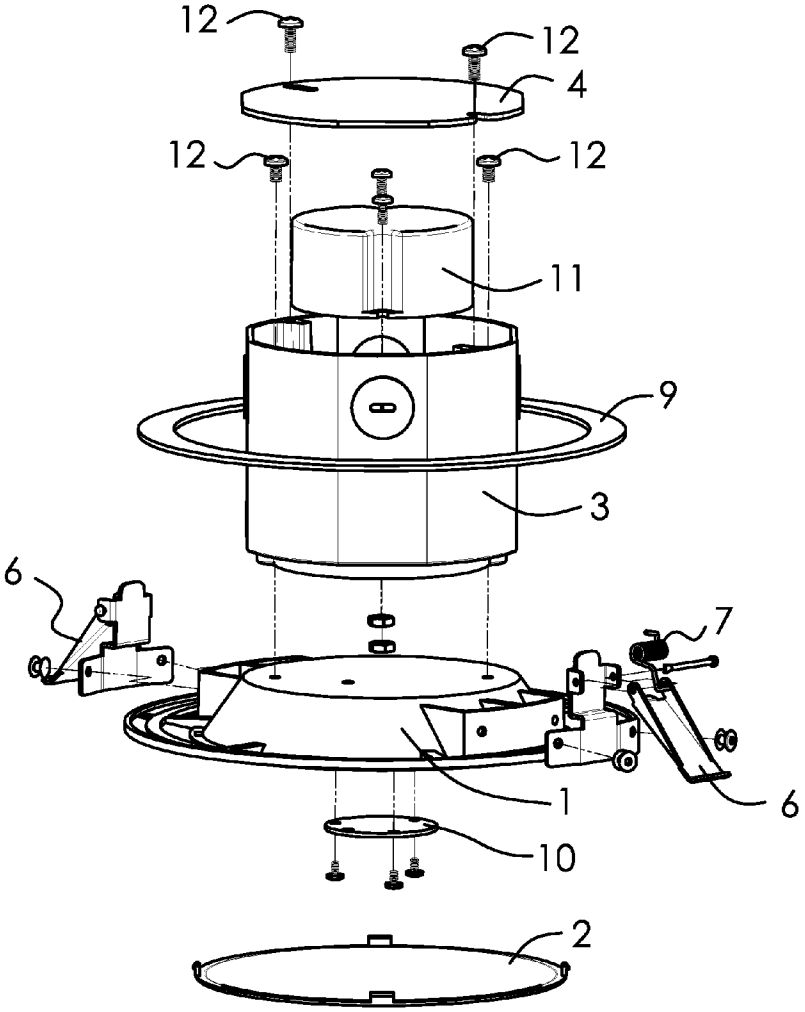
FIG. 1 is an exploded view of one embodiment of the present invention recessed light fixture.
Figure 5:
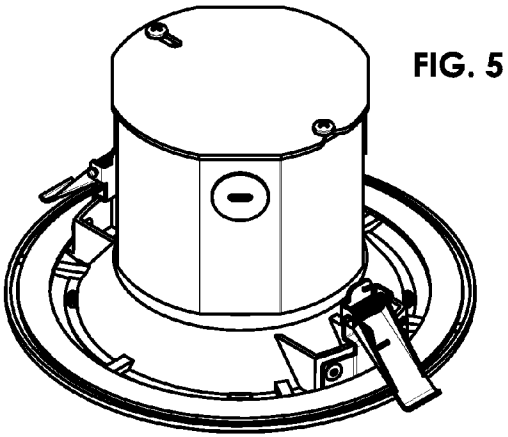
FIG. 5 is an upper perspective view.
Figure 8:
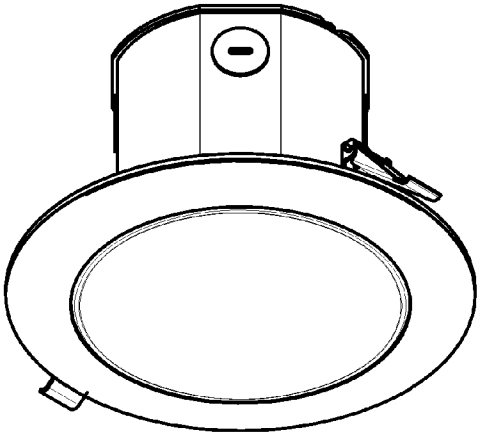
FIG. 8 is a lower perspective view.

The present invention is directed to a recessed light fixture employing solid state electronics and preferably used in sheetrock ceiling applications for residential homes or commercial buildings. FIG. 1 is an exploded view of one preferred embodiment. The light fixture embodiment shown in FIGS. 1-8 includes a trim 1 having a truncated cone shape. That is, the bottom side of the trim 1 is concave with a sloped circumferential wall and the top side of the trim is convex with a sloped circumferential wall; the center of the trim transitions from a sloped wall to a flat disk. At the outer periphery of the trim 1, the sloped wall transitions to a flat, annular lip or flange.

Figure 4:
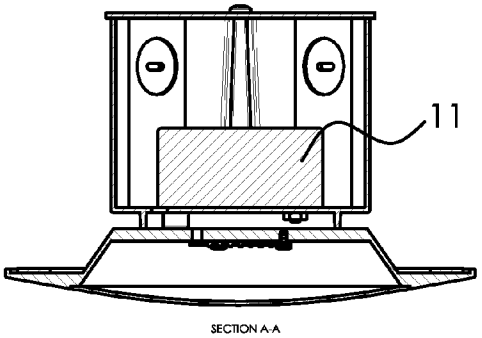
FIG. 4 is a cross-sectional view.
Figure 7:
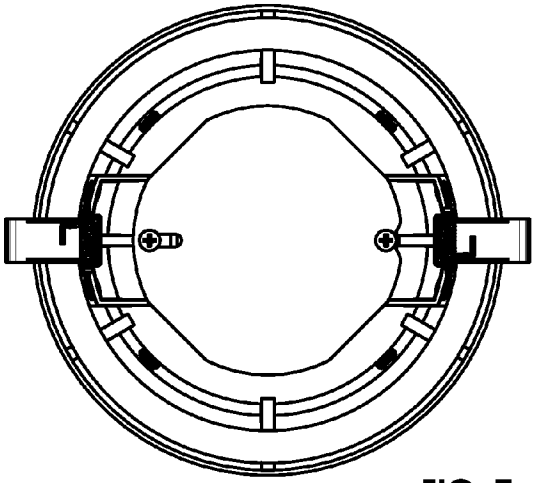
FIG. 7 is a top plan view.
Figure 3:
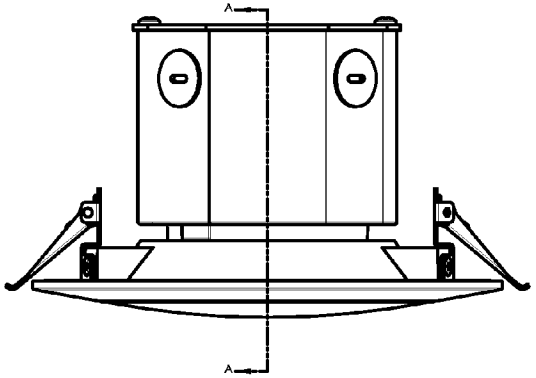
FIG. 3 is a side elevational view.
Figure 6:
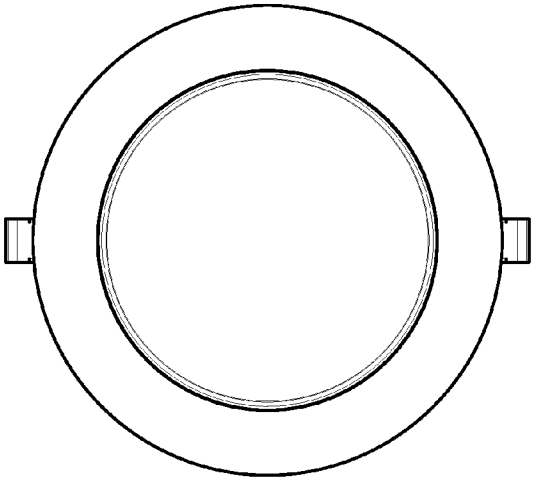
FIG. 6 is a bottom view.
Figure 10:
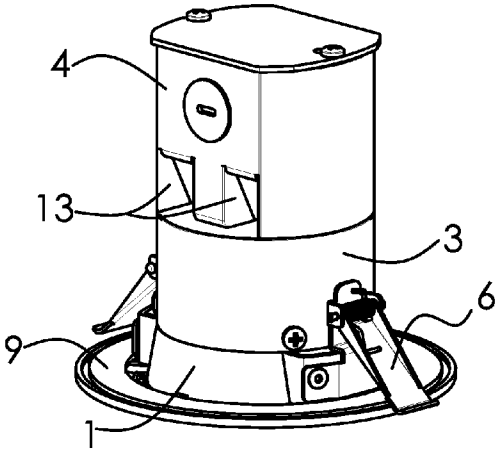
FIG. 10 is a perspective view of the fixture from FIG. 9.

Underneath the trim 1 is an LED board 10 that is powered by a LED driver 11 shown in FIG. 1 and in the cross-sectional view of FIG. 4. The LED driver 11 is a conventional power supply for the LEDs with standard AC in and DC output to the LEDs. The LED driver 11 is connected to household wiring via a quick connect, wire nut, or the like, all contained inside a junction box 3. The LED board 10 contains one or an array of LEDs as the lighting source. The interior of the truncated cone of the trim 1 may be lined, coated, or painted with a light reflective material to help reflect or focus the light from the LED board 10. Alternative embodiments may use a compact fluorescent tube, for example, instead of the LED. The LED board 10 is covered by an optional lens 2 or a diffuser that snaps on, screws on, or is attached by a fastener.

With the present invention designs and to be detailed below, the standard "can" used in conventional recessed lighting fixtures can be omitted. This saves manufacturing materials, costs, simplifies construction, reduces bulk, and facilitates easy installation.

The outer periphery of the trim 1 has an optional flange or lip. An optional air tight, annular shaped gasket 9 is attached to this flange or annular lip and abuts the sheetrock ceiling surface when the fixture is installed. The underside of the flange may be decorated or may have attachments for decorative trim rings.

Directly above the trim 1 is the junction box or J-box 3. The J-box 3 provides a housing enclosing a confluence of wires from the power source and ground wire, etc., and has optional supports to hold the wiring in place, and includes punch-outs that provide passage of wiring through the walls of the J-box 3. As indicated in FIG. 4, the LED driver 11 and its wiring connections are located inside the J-box 3. A cover plate 4 is attached to the top of the J-box 3 by screws 12 or like fasteners, or hinged and kept shut with a latch. An external housing enclosing all of the hardware is not necessary.

As seen in FIGS. 1-4, the J-box 3 contains the LED driver 11 inside. Specifically, as seen in FIG. 4, the LED driver 11 sits at the interior bottom of the J-box 3, and the J-box 3 is attached to the top of the trim 1. The engagement between the J-box 3 and the trim 1 may be a flush, touching, or contiguous engagement, or there may be an air gap between the two components separated by one or more mounting bosses, as seen in FIG. 4. The air gap between the bottom of the J-box 3 and the trim 1 serves as thermal insulation to keep the heat generated in the LED driver 11 contained. Electrical wiring connecting the LED driver 11 and the LED board 10 may extend through this gap. Optionally, the air gap may be partially filled or occupied with a heat sink type material.

In an alternative embodiment, the J-box 3 may be made from a metallic material instead of plastic that helps with thermal conduction and radiation. The J-box 3 is flush-mounted against the trim 1 with no gap, and the trim is also made from a thermal conductive metal. Thus, the trim 1 acts as a heat sink to conduct and radiate heat away from the LED driver 11 and the LED board 10. The preferred embodiment trim 1 is made from cast, forged, or stamped aluminum for thermal conduction. Other materials such as steel, iron, zinc, etc. and alloys thereof are contemplated.

Figure 2:
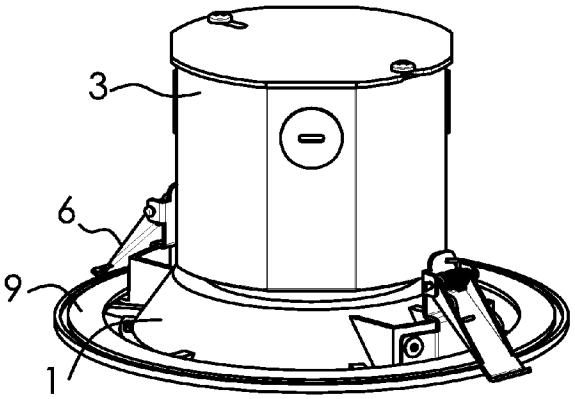
FIG. 2 is a perspective view of the fixture from FIG. 1.

At diametrically opposed sides of the trim 1 are preferably two retainer brackets 6, shown in FIGS. 1-2 in their installed state. Each bracket 6 is biased by a coiled, bar, or like spring 7 into the down position shown in FIGS. 1-2. During installation, the homeowner or electrician using finger pressure pushes the brackets 6 upward so they pivot up and toward the outside of the J-box 3. The light fixture is then inserted up into the pre-formed hole in the sheetrock ceiling. The finger pressure on the brackets 6 is released, and the spring 7 urges the bracket 6 to pivot back downward to the position shown in FIGS. 1-2. Functioning as legs, the brackets 6 support the weight of the fixture resting on the sheetrock ceiling panel or tile. Moreover, the brackets 6 and flange on the trim 1 together pinch the sheetrock ceiling panel or tile between it and the lip of the trim to further stabilize the fixture after installation.

The J-box 3 is preferably made from a thermoplastic material or like polymer. The punch-outs are formed into the walls with score lines, pre-cuts, perforations, etc. The J-box may also be made partially or entirely from stamped steel, aluminum, zinc, or like metals and alloys.

Figure 9:
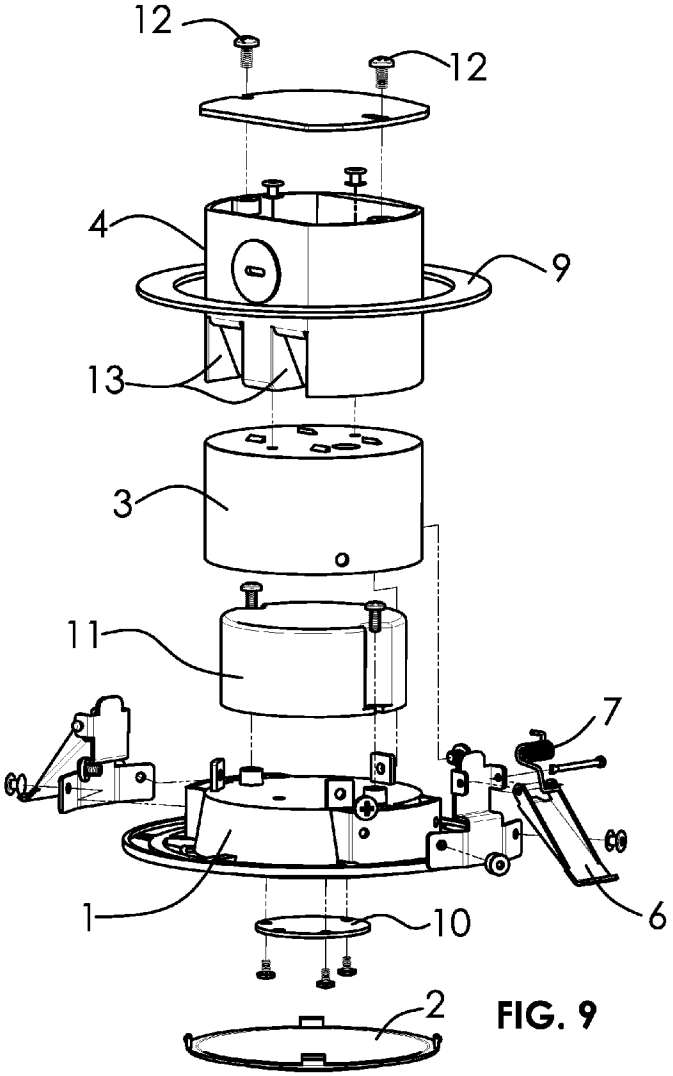
FIG. 9 is an exploded view of an alternative embodiment of the present invention recessed light fixture.
Figure 13:
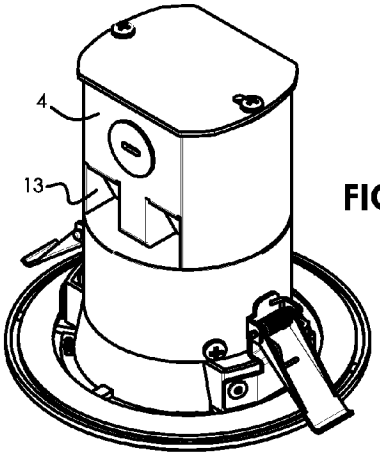
FIG. 13 is an upper perspective view.
Figure 16:
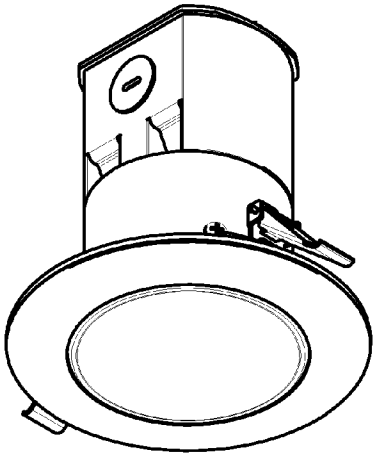
FIG. 16 is a lower perspective view.

FIGS. 9-16 show a second embodiment. FIG. 9 is an exploded view of the recessed LED light fixture preferably for sheetrock applications. In this embodiment, the LED driver 11 is directly mounted to the trim 1 via bosses, rivets, or fasteners. An optional housing or cover 3 with an open bottom fits over the LED driver 11 and encloses LED the driver 11 from above. As seen in the cross-sectional view of FIG. 12, there may be space between the cover 3 and LED driver 11, which open space serves as a thermal insulation to contain the heat from the LED driver 11 within the cover 3. In such instance, the cover 3 is preferable made from an insulator material such as plastic.

Figure 12:
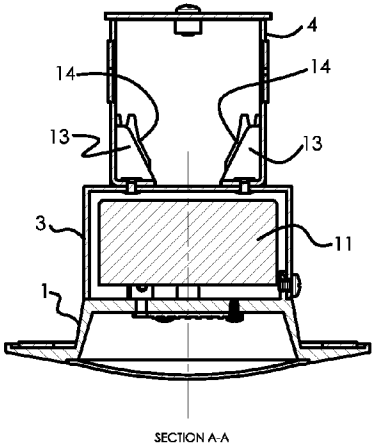
FIG. 12 is a cross-sectional view.
Figure 15:
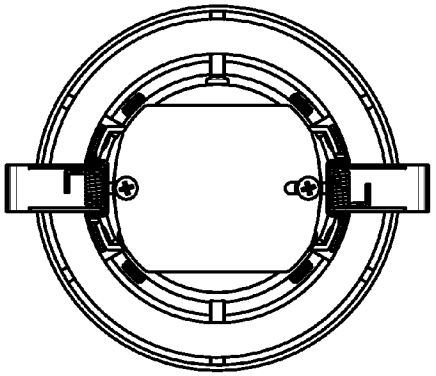
FIG. 15 is a top plan view.
Figure 11:
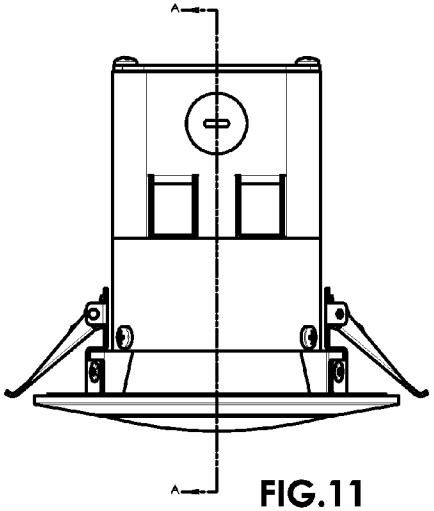
FIG. 11 is a side elevational view.
Figure 14:
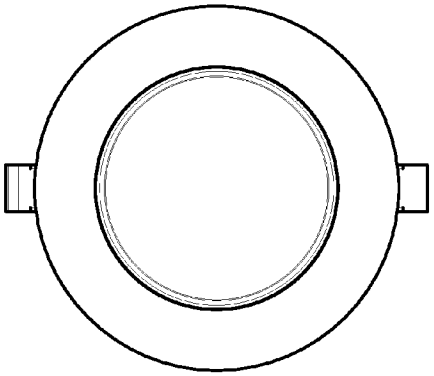
FIG. 14 is a bottom view.

Immediately above the cover 3 and directly mounted to it is a J-box 4. The J-box 4 includes ROMEX® cable ports 13 that lead into the interior of the J-box 4, as best seen in the cross-sectional view of FIG. 12. A ROMEX® cable is known in the art; it generally describes a class of electrical cables sheathed in a plastic covering. The plastic covering on the metal wiring or cables creates a more slippery surface and makes it easier for the electrician to pull the wiring through walls, attic, conduits, and the like without too much frictional drag. Inside the J-box 4 right past the ports 13 are retainer clips 14 that, as shown in FIG. 12, are biased downward. So when a ROMEX® cable is inserted into the port 13, the biased clip 14 is urged and pushes downward on the plastic sheath of the ROMEX® cable thus holding the cable in place. This helps the electrician with the manual wiring and electrical connections to be made inside the J-box 4. The J-box 4 includes more punch-outs that can be popped opened if needed for more wires to pass through. The top cover 5 of the J-box 4, secured by two screws 17, can be rotated to partially open or completely removed for access to the interior if needed.

As depicted in the cross-section of FIG. 12, there is preferably an air gap located between the LED driver 11 and the trim 1 via one or more feet-like mounting bosses to space the components apart. In an alternative embodiment, the driver 11 and trim 1 may be flush-mounted or directly abut each other to close the air gap. This may be done for thermal conduction so that the heat generated by the driver 11 is conducted downward through the metallic trim 1 and radiated away by the trim 1 and other hardware.

In the embodiments shown, no conventional heat sink with its large mass of metal and intricate cooling fins, etc., is required. When heat must be dissipated, the trim 1 if made from a thermal conductive material, such as iron, steel, aluminum, zinc, etc. and alloys thereof, acts as the heat sink. Although only two brackets 7 as shown in FIGS. 9-16, there may be fewer or more brackets spaced around the periphery of the trim 1. No outer "can" housing or enclosure is needed.

FIG. 9 shows the preferred mounting means, which includes a bar shaped retainer bracket 7 having a curled distal end and pivoted at its proximal end by a pivot pin 9. Via the pivot pin 9, the bracket 7 is attached to the base bracket 6. A coiled spring 8 urges the distal end of the bracket 7 downward toward the trim 1. During installation, the electrician with finger pressure flips the preferably two brackets 7 upward, against spring bias, so their distal ends are proximate to the J-box 4. The light fixture is inserted through the hole in the sheetrock panel or ceiling tile where the finger pressure is released so the brackets 7 flip downward under spring pressure toward their initial position. The distal ends of the brackets 7 now press against the top side of the sheet rock panel while the upper annular lip of the trim 1 abuts the bottom side of the sheet rock panel; the thickness of the sheet rock panel is thus pinched between the brackets 7 and the trim's annular lip.

As installed, the weight of the light fixture is supported by the brackets 7 resting on the sheet rock panel while the pinching action rigidly stabilizes the light fixture. An optional air tight gasket 10 may be placed on the top side of the trim's annular lip to seal the environment underneath the sheetrock panel, which is the working/living space, from the environment above the sheetrock panel, which is the dead air space.

In alternative embodiments shown in FIGS. 17-31, the LED light fixture may further include a magnetic trim attachment for consumer changeable finish and trim, and a J-box design with conduit knock-out and push-in ROMEX® wiring, resulting in a self-contained luminaire that installs directly into a sheetrock ceiling or the like, without the need for a "can" housing or a bulky heat sink.

Figure 18:
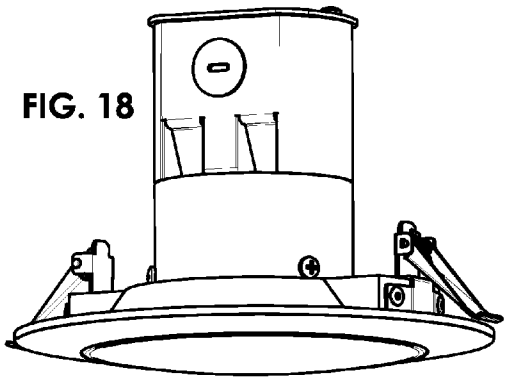
FIGS. 17, 18 are perspective views of alternative embodiment recessed light fixtures having a standard 6-inch diameter.
Figure 20:
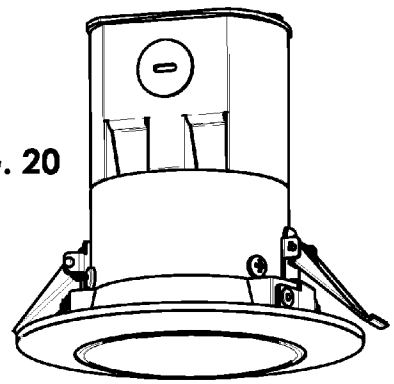
FIGS. 19, 20 are perspective views of alternative embodiment recessed light fixtures using a magnetic trim attachment having a standard 4-inch diameter.
Figure 17:
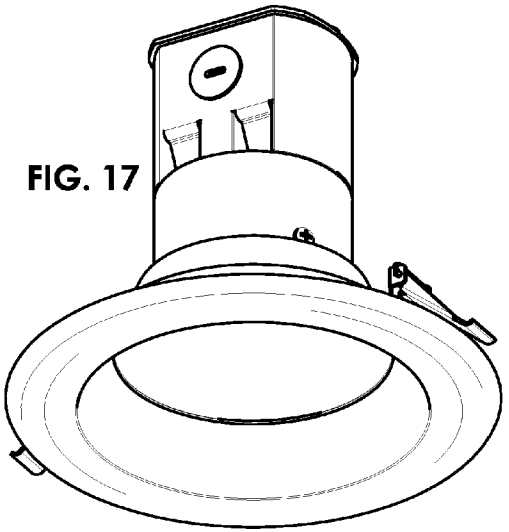
Figure 19:
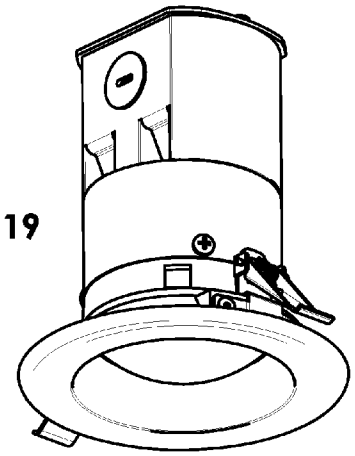

FIGS. 17-20 are perspective views of alternative embodiments to the present invention recessed light fixture employing solid state electronics and preferably used in sheetrock ceiling applications for residential homes or commercial buildings. FIGS. 17, 18 show exemplary light fixtures in a standard 6-inch diameter and FIGS. 19-20 show light fixtures for a standard 4-inch diameter. Other light fixture diameters such as 5-inch are contemplated. The basic construction of the light fixtures shown in FIGS. 17-20 have already been described above in connection with FIGS. 9-16.

Figure 22:
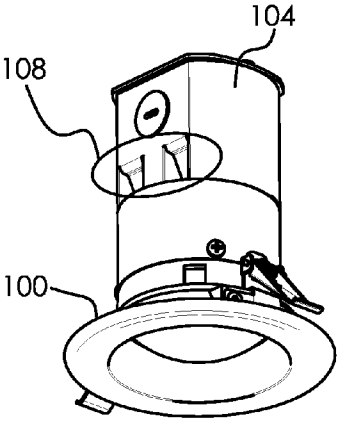
FIGS. 21, 22 show a knock-out conduit and push-in ROMEX® options.
Figure 21:
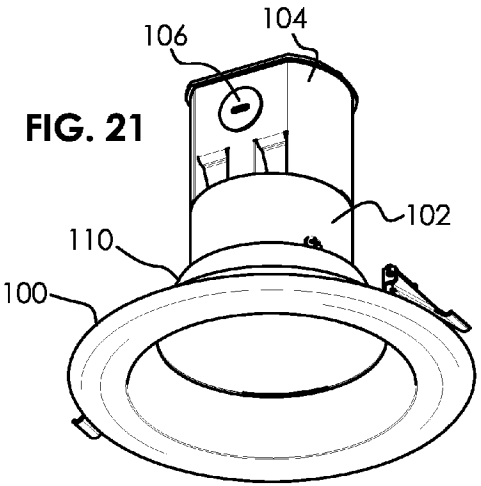

FIGS. 21, 22 are detailed views further illustrating pre-cut or scored blanks, punch-outs, or knock-outs 106 covering openings in the J-box 104. Ports or openings 108 for receiving the ROMEX® cables are also seen. The J-box 104 preferably sits atop the LED driver (not shown) enclosed by a cover or housing 102. The housing 102 and J-box 104 have a minimalist, streamlined profile to enable easy, snag free installation into the ceiling. As such, both have essentially matching or identical outside diameters and similar shapes. The J-box 104, the housing 102, or both may have straight cuts along parallel chords to reduce their overall bulk, appearing somewhat as a flattened cylinder. The matching or streamlined profile makes it easier for the electrician to install, because the entire housing is pushed through a small hole cut into the sheetrock ceiling and the slim, circular profile minimizes the chance of any part of the housing snagging or bumping into the lip of the hole. The J-box 104 and LED driver housing 102 stack sits atop the trim 110 and beneath it is the trim ring 100.

Figure 23:
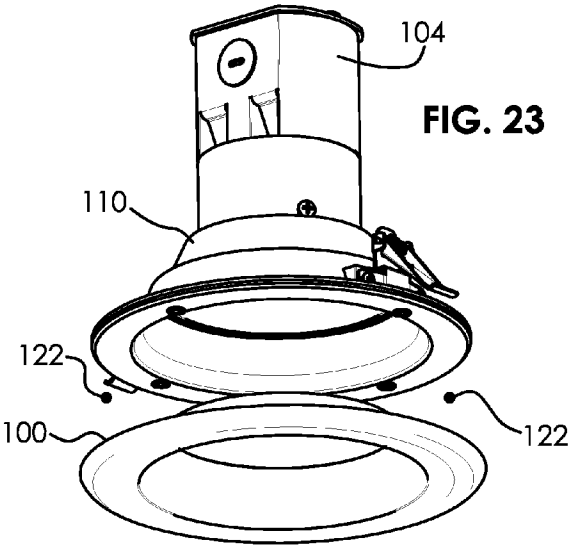
FIGS. 23, 24 show magnetic trim attachment.
Figure 24:
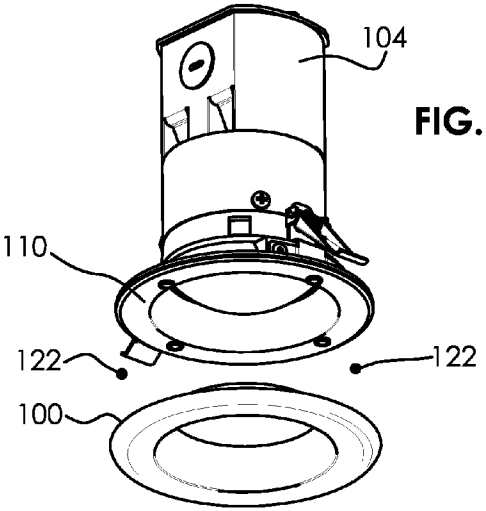

FIGS. 23, 24 show assembly/disassembly of the trim ring 100 to/from the trim 110. The trim ring 100 is thus replaceable or changeable by the consumer or end user. The trim ring 100 is highly visible to the consumer so that it can be made with a variety of decorative finishes, colors, shapes, bevels, edges, thicknesses, etc. to match the interior décor and color scheme of the home, office, commercial lobby, business establishment, etc. The alternative trim rings 100 may be packaged with the light fixture or sold separately.

Various means for attaching the trim ring 100 to the trim 110 are contemplated. In the preferred embodiment, the trim ring 100 is attached to the trim 110 via one, two or more magnets 122 disposed around the circumference as shown in FIGS. 23, 24. The magnets 122 may include permanent magnets, rare earth, super magnets, etc. Generally, the trim ring 100 or a portion thereof is preferably a ferromagnetic metal, and/or preferably a portion of or all of the trim 110 is a ferromagnetic metal. The magnets 122 are fitted into either the trim ring 100 or trim 110 and provide the attractive force to firmly hold the two components together, yet by hand manipulation of the electrician or installer, may be separated at will. This technology is disclosed in, for example, U.S. Pat. No. 8,454,204 (Chang), titled "Recessed LED Lighting Fixture," the entire contents of which are hereby incorporated by reference. Means for mechanically joining the trim ring to the trim include flip locks, interference fits, wedge fits, screw interface, C-clamps, screws, threaded components, spring clips, replaceable quick ties, and the like are contemplated, and any one or combination can be used in place of or in combination with the magnets 122.

Figure 25:
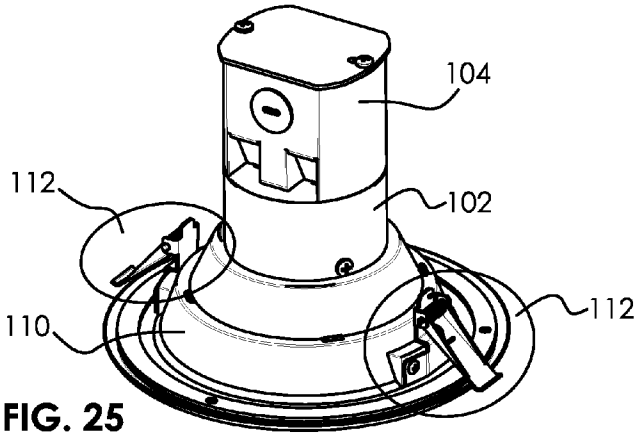
FIG. 25 shows a coiled spring retainer feature for holding the recessed fixture inside a sheet rock ceiling.

FIG. 25 shows an alternative embodiment light fixture with retainer brackets 112 used to hold the fixture in place on the sheetrock ceiling. The brackets 112 are spring biased to clamp down on the sheetrock ceiling as described in connection with FIGS. 1 and 9. There can be three or more brackets if necessary. As compared to the large and bulky can supports/legs known in the art, the brackets 112 are very small and simple in construction and made from a few pieces for easy assembly during production. Much hardware for the support structure is eliminated, because the great mass of the can and the platform or pan on which the can sits have been omitted, since no can is used. The typically massive, heavy, finned, metal heat sink is omitted as well. Also, because of the rigid but brittle nature of sheetrock, a low profile and a smaller footprint for the light fixture are desirable, as less mass and bulk (e.g., omitting the can and heat sink, simplifying the support bracket) are also important so as not to crack, chip, warp, sag, or damage the sheetrock tile or slab during installation and during the light fixture's service life.

Figure 27:
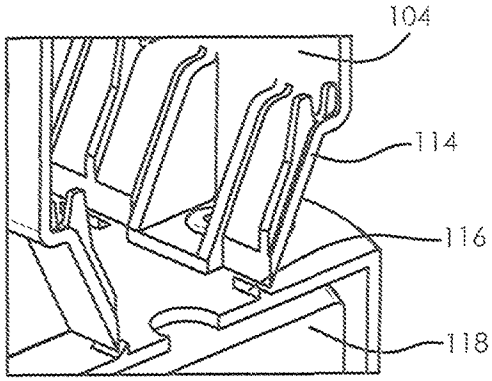
FIGS. 26-28 show the interior of an integrated junction box design with conduit knock-out and push-in ROMEX® wiring strain relief mechanisms.
Figure 28:
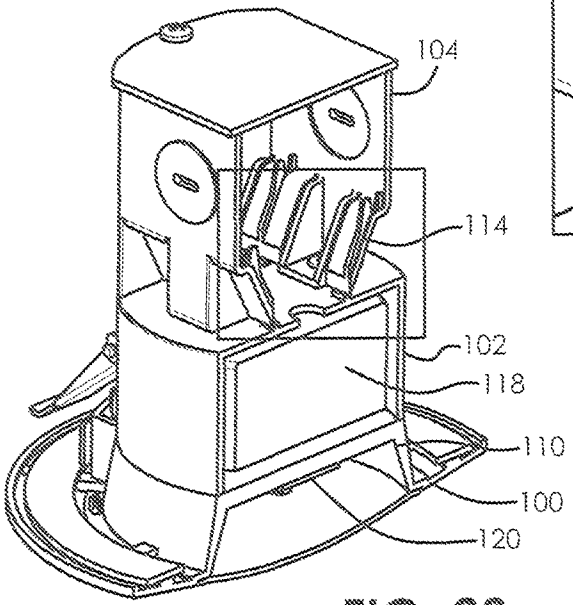
Figure 26:
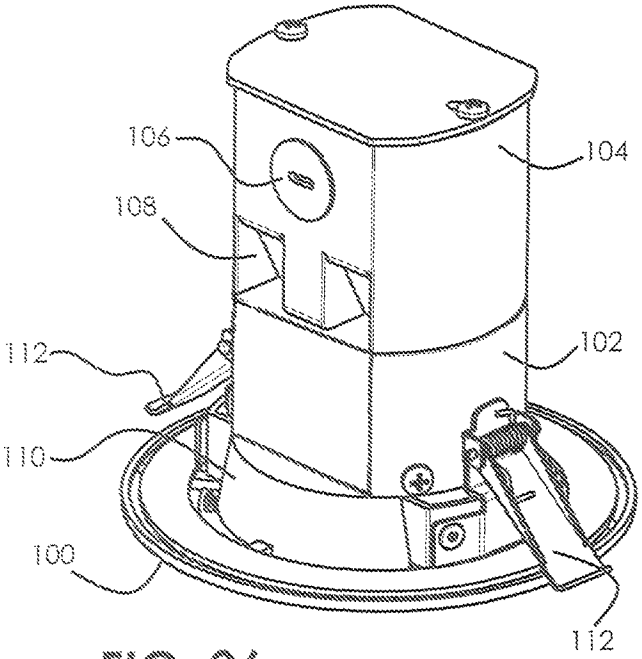

FIGS. 26-28 show an alternative embodiment LED light fixture with cutaway views exposing the interiors of the J-box 104 and LED driver housing 102. Inside the LED driver housing 102 is an LED driver 118, which construction is known in the art, which is used to power the light source/LED array 120 beneath it. Beneficially, electrical wiring from the house or building mains are brought into the J-box via the knock-outs 106 or via the ROMEX® openings 108. In the cutaway views of FIGS. 27, 28, it can be seen that inside each ROMEX® opening 108 is a retainer clip or flap door 114. Being preferably molded from plastic as part of the J-box 104, the flap doors 114 have some resilience so that they are normally biased closed at the opening 108 and swing open in an inward direction. The flap doors 114 have a beveled edge similar to a blade to push against the plastic sheath covering on a standard ROMEX® cable. The closing bias in the flap door 114 with the sharp beveled edge pushing into the sheath covering the ROMEX® cable create a drag if there is any tendency for the ROMEX® cable to pull out of the J-box 104. The outward, pull-out tendency often is a result of gravity acting on the heavy cables, or the electrician adjusting the electrical lines during installation. Accidental detachment from an inadvertent pull-out may create a break in the electrical circuit, which event wastes the electrician's time and effort in having to find the electrical break and reattaching the electrical connection.

As seen in FIGS. 26-28, the openings 108 and their respective flap doors 114 are preferably positioned on the flat walls of the cylindrical J-box 104. The flat walls, as described above, are created by taking parallel chords along the cylindrical J-box 104. There are preferably two opposed flat walls so the openings 108 are situated in diametrically opposed positions (rather than at an acute or right angle). The flattened sides of the J-box 104 reveal a flat surface at the circular top of the housing 102 on the opposite sides of the J-box. The revealed flat surfaces of the housing top serve as the floor upon which the ROMEX® cables rest and have their weight supported.

An optional barb 114 rising from the floor of the J-box 104 and located at the opening 108 opposes the bias of the flap door 114. More precisely, the barb 116 together with the flap door bias pinch the ROMEX® cable to further resist accidental pull-out. In addition, as best seen in FIG. 27, the angled faces of the flap door 114 and barb 116 create a unidirectional, easy push-in condition for the cable where there is little drag pushing the cable in to the J-box 104, but create a lot of drag pulling the cable out. Beneficially, the location of the ROMEX® cables at the bottom of the J-box efficiently places the electrical lines immediately adjacent the LED driver 118.

Figure 30:
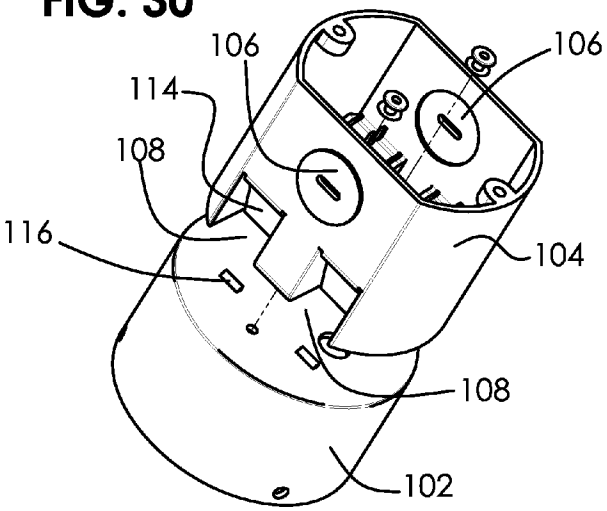
FIGS. 29-31 show the interior of the integrated junction box with a push-in ROMEX® wire held in place by strain relief mechanisms.
Figure 31:
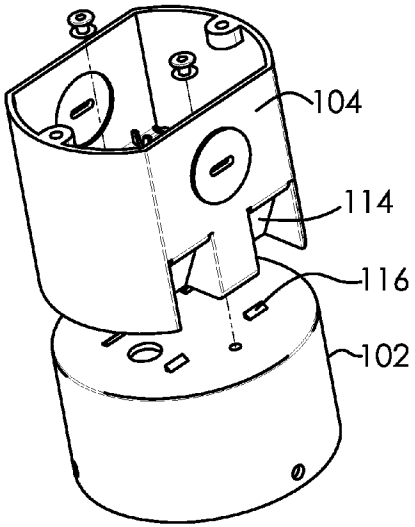
Figure 29:
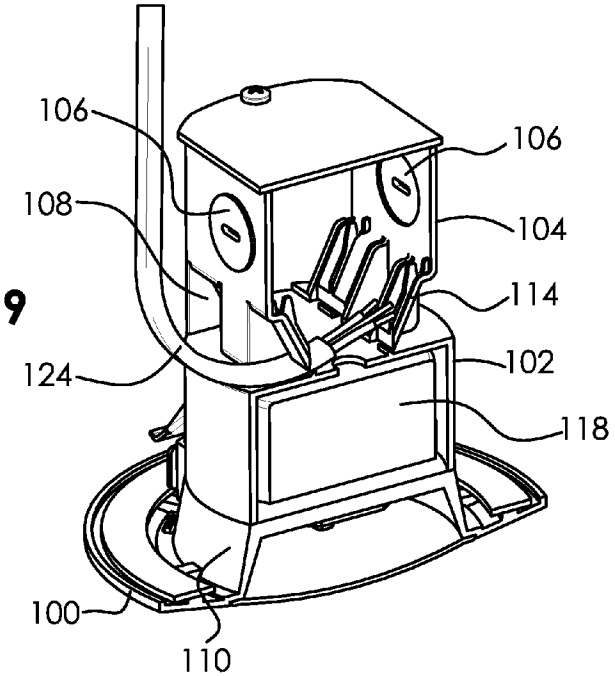

FIGS. 29-30 are different views of the J-box interior, and FIG. 29 shows a ROMEX® cable 124 installed in the J-box 104. As described above and shown in FIG. 29, the cable 124 is pinched between the flap door 114 and the barb 116 thus reducing pull out and holding the cable 124 in place for easier access by the electrician. FIGS. 30, 31 show opposite sides of the J-box 104. Each side has preferably two openings 108, and each opening has its own flap door 114 and barb 116. In the preferred embodiment, there are two pairs of opposed openings 108 for receiving ROMEX® or like wires and cables 124 on opposite sides of the J-box 104. In the preferred embodiment, opposite faces of the J-box 104 also feature knock-outs 106 for addition wiring leading into and out of the interior. Of course, more or fewer cable openings 108 and knock-outs 106 are contemplated and their locations on the J-box 104 may be varied as needed. FIGS. 30-31 show the J-box 104 separated from the top of the housing 102 to show the locations of the barbs 116.

While particular forms of the invention have been illustrated and described, it will be apparent that various modifications can be made without departing from the spirit and scope of the invention. It is contemplated that components from one embodiment may be combined with components from another embodiment.

What is claimed is:

1. A recessed, solid state light fixture, comprising:

a truncated-cone-shape trim having a top surface and a concave bottom surface, wherein the concave bottom surface includes means for reflecting;

an LED array disposed directly against the bottom surface of the trim;

a housing containing only an LED driver having a top and a bottom, the LED driver disposed directly on the top surface of the trim, and electrically wired to the LED array;

a junction box stacked directly on top of the housing and electrically wired to the LED driver, the junction box having at least one of ports with retainer clips and punch outs for cable and wire access;

wherein the housing and junction box have matching diameters and matching straight cuts along their chords; and means for stabilizing the fixture, disposed on the top surface of the trim at a periphery.

2. The recessed, solid state light fixture of claim 1, wherein the junction box contains the LED driver therein.

3. The recessed, solid state light fixture of claim 1, wherein the concave bottom of the trim is enclosed by a lens.

4. The recessed, solid state light fixture of claim 1, the fixture further comprising a trim ring detachably attached to the trim.

5. The recessed, solid state light fixture of claim 4, wherein magnets attach the trim ring to the trim.

6. The recessed, solid state light fixture of claim 1, wherein the means for stabilizing includes a bracket that is pivoted at a proximal end and biased at a distal end to urge the distal end toward the periphery of the trim.

7. A recessed, solid state light fixture, comprising:

a truncated-cone-shape trim having a top surface and a concave bottom surface, wherein the concave bottom surface includes means for reflecting;

an LED array directly engaging the bottom surface of the trim;

an LED driver disposed on the top surface of the trim and electrically wired to the LED array;

a cover, enclosing the LED driver, having a top and an open bottom;

a junction box directly engaging the top of the cover and electrically wired to the LED driver, the junction box having ports with biased flap doors and punch outs for cable and wire access;

wherein the cover and junction box have matching outside diameters and matching straight cuts along their chords; and means for stabilizing the fixture, disposed on the top surface of the trim at a periphery.

8. The recessed, solid state light fixture of claim 7, the fixture further comprising a trim ring attached to the trim with magnets.

9. The recessed, solid state light fixture of claim 7, wherein the LED driver includes bosses to separate the LED driver from the trim and provide an air gap therebetween.

10. The recessed, solid state light fixture of claim 7, wherein an air space is created between the interior of the cover and the LED driver.

11. The recessed, solid state light fixture of claim 7, wherein a barb is disposed inside the flap door of the junction box.

12. The recessed, solid state light fixture of claim 7, wherein the cover and junction box include similar profiles.

13. The recessed, solid state light fixture of claim 7, wherein the cover includes a thermal insulating material.

14. A recessed, solid state light fixture, comprising:

a truncated-cone-shape trim having a top surface and a concave bottom surface;

an LED array directly engaging the bottom surface of the trim;

a light reflector disposed within the concave bottom surface surrounding the LED array;

an LED driver disposed on the top surface of the trim and electrically wired to the LED array;

a cover having a top and an open bottom at least partially enclosing the LED driver and mounted directly to the top of the trim;

a junction box stacked directly on top of the cover and electrically wired to the LED driver, the junction box having opposed ports with respective biased flap doors and punch outs for cable and wire access;

wherein the cover and junction box have matching outside diameters and matching straight cuts along their chords; and a plurality of spring-biased brackets disposed on the top surface of the trim at a periphery thereof.

15. The recessed, solid state light fixture of claim 14, wherein the cover includes a thermal insulating material to minimize conduction and radiation of heat therethrough.

16. The recessed, solid state light fixture of claim 14, wherein the light reflector includes at least one of a coating with light reflective material, paint with light reflective material, and a cone covered with light reflective material.

17. The recessed, solid state light fixture of claim 14, wherein the fixture further comprises a trim ring attached to the trim.

* * * * *